US005397126A

United States Patent [19]

Allen

[11] Patent Number: 5,397,126

[45] Date of Patent: Mar. 14, 1995

[54] METAL WOOD GOLF CLUB WITH TRUE HEEL AND TOE WEIGHTING

[75] Inventor: Dillis V. Allen, Elgin, Ill.

[73] Assignee: Vardon Golf Company, Inc., Elk Grove Village, Ill.

[21] Appl. No.: 22,904

[22] Filed: Feb. 26, 1993

[51] Int. Cl.[6] ..... A63B 53/04

[52] U.S. Cl. ..... 273/167 H; 273/167 F; 273/169; 273/172

[58] Field of Search ..... 273/167 F, 167 H, 169, 273/167 R, 172, 167 A-167 E, 167 G, 167 J, 167 K, 78, 170, 171, 173-175

[56] References Cited

U.S. PATENT DOCUMENTS

| | | | |
|---|---|---|---|
| D. 240,948 | 8/1976 | Redoutey | 273/167 F |
| 2,460,435 | 2/1949 | Schaffer | 273/169 |
| 3,847,399 | 11/1974 | Raymont | 273/169 |
| 3,941,390 | 3/1976 | Hussey | 273/172 |
| 4,432,549 | 2/1984 | Zebelean | 273/167 H |
| 4,681,321 | 7/1987 | Chen et al. | 273/169 |
| 4,930,781 | 6/1990 | Allen | 273/167 F |
| 4,938,470 | 7/1990 | Antonious | 273/167 H |
| 5,060,951 | 10/1991 | Allen | 273/167 H |
| 5,067,715 | 11/1991 | Schmidt et al. | 273/167 H |
| 5,141,230 | 8/1992 | Antonious | 273/167 H |
| 5,301,941 | 4/1994 | Allen | 273/167 H |

FOREIGN PATENT DOCUMENTS

| | | | |
|---|---|---|---|
| 5049715 | 3/1993 | Japan | 273/167 A |

*Primary Examiner*—Vincent Millin
*Assistant Examiner*—Steven B. Wong
*Attorney, Agent, or Firm*—D. V. Allen

[57] ABSTRACT

A metal wood golf club having an enlarged metal club head with a crowned top wall extending rearwardly from a ball striking face wall, a toe wall and a heel wall also projecting rearwardly from the face wall—but without a sole plate. The toe wall and heel wall are enclosed by the top wall and a pair of spaced generally vertical weighting walls integral with and extending rearwardly from the forward wall. The two areas enclosed by the top wall, heel and toe walls, and weight walls are hollow to achieve the desired head weight, and the area between the weight walls is open, and the weight of the sole plate normally enclosing that area is redistributed to the weight walls to achieve true heel and toe weighting.

12 Claims, 5 Drawing Sheets

METAL WOOD GOLF CLUB WITH TRUE HEEL AND TOE WEIGHTING

BACKGROUND OF THE INVENTION

Investment casting techniques innovated in the late 1960s have revolutionized the design, construction and performance of golf club heads up to the present time. Initially only novelty putters and irons were investment cast, and it was only until the early years of the 1980s that investment cast metal woods achieved any degree of commercial success. The initial iron club heads that were investment cast in the very late 1960s and early 1970s innovated the cavity backed club heads made possible by investment casting which enabled the molder and tool designer to form rather severe surface changes in the tooling that were not possible in prior manufacturing techniques for irons which were predominantly at that time forgings. The forging technology was expensive because of the repetition of forging impacts and the necessity for progressive tooling that rendered the forging process considerably more expensive than the investment casting process and that distinction is true today although there have been recent techniques in forging technology to increase the severity of surface contours albe them at considerable expense.

The investment casting process, sometimes known as the lost wax process, permits the casting of complex shapes found beneficial in golf club technology, because the ceramic material of the mold is formed by dipping a wax master impression repeatedly into a ceramic slurry with drying periods in-between and with a silica coating that permits undercutting and abrupt surface changes almost without limitation since the wax is melted from the interior of the ceramic mold after complete hardening.

This process was adopted in the 1980s to manufacture "wooden" club heads and was found particularly successful because the construction of these heads requires interior undercuts and thin walls because of their stainless steel construction. The metal wood club head, in order to conform to commonly acceptable club head weights on the order of 195 to 210 grams when constructed of stainless steel, must have extremely thin wall thicknesses on the order of 0.020 to 0.070 inches on the perimeter walls to a maximum of 0.125 inches on the forward wall which is the ball striking surface. This ball striking surface, even utilizing a high strength stainless steel such as 17-4, without reinforcement, must have a thickness of at least 0.125 inches to maintain its structural integrity for the high club head speed player of today who not uncommonly has speeds in the range of 100 to 150 feet per second at ball impact.

Faced with this dilemma of manufacturing a club head of adequate strength while limiting the weight of the club head in a driving metal wood in the range of 195 to 210 grams, designers have found it difficult to increase the perimeter weighting effect of the club head.

In an iron club, perimeter weighting is an easier task because for a given swing weight, iron club heads can be considerably heavier than metal woods because the iron shafts are shorter. So attempts to increase perimeter weighting over the past decade have been more successful in irons than "wooden" club heads. Since the innovation of investment casting in iron technology in the late 1960s, this technique has been utilized to increase the perimeter weighting of the club head or more particularly a redistribution of the weight of the head itself away from the hitting area to the perimeter around the hitting area, usually by providing a perimeter wall extending rearwardly from the face that results in a rear cavity behind the ball striking area. Such a club head configuration has been found over the last two plus decades to enable the average golfer, as well as the professional, to realize a more forgiving hitting area and by that we mean that somewhat off-center hits from the geometric center of the face of the club results in shots substantially the same as those hits on the center of the club. Today it is not uncommon to find a majority of professional golfers playing in any tournament with investment cast perimeter weighted irons confirming the validity of this perimeter weighting technology.

Metal woods by definition are perimeter weighted because in order to achieve the weight limitation of the club head described above with stainless steel materials, it is necessary to construct the walls of the club head very thin which necessarily produces a shell-type construction where the rearwardly extending wall extends from the perimeter of the forward ball striking wall, and this results in an inherently perimeter weighted club, not by design but by a logical requirement.

In the Raymont, U.S. Pat. No. 3,847,399 issued Nov. 12, 1974, assigned to the assignee of the present invention, a system is disclosed for increasing the perimeter weighting effect of a golf club by a pattern of reinforcing elements in the ball striking area that permits the ball striking area to be lighter than normal, enabling the designer to utilize that weight saved on the forward face by adding it to the perimeter wall and thereby enhancing perimeter weighting.

This technique devised by Mr. Raymont was adopted in the late 1980s by many tool designers of investment cast metal woods to increase the strength of the forward face of the metal woods to maintain the requirement for total overall head weight and to redistribute the weight to the relatively thin investment cast perimeter walls permitting these walls to not only have greater structural integrity and provide easier molding and less rejects, but also to enhance the perimeter weighting of these metal woods. Most major companies in the golf industry manufacturing metal woods in the late 1980s were licensed under the Raymont patent.

In 1991, the Allen, U.S. Pat. No. 5,060,951 issued entitled "Metal Headed Golf Club With Enlarged Face", also assigned to the assignee of the present invention, and it discloses an investment cast metal wood with an enlarged club face depth(height) on the order of at least 1.625 inches. Such a face depth was not formerly believed possible because of the requirement for face structural integrity under the high impact loads at 100 to 150 feet per second, and the weight requirement of the club head of 195 to 210 grams. In this Allen patent, a labyrinth of reinforcing elements similar to Mr. Raymont's was utilized not to re-distribute face weight but instead to enlarge face area while maintaining overall club head weight. An ancillary and important advantage of this development, utilized by many present day designers of "jumbo" metal wood heads, is the fact that an enlarged club face produces a sweet spot enlargement far greater than the enlargement of the club face itself.

There are, however, limitations on the effectiveness of the reinforcing elements on the face wall of investment cast clubs and particularly metal woods. Because investment cast metal woods must have hollow interiors, these interiors must be formed by removable core pieces. To the present day face wall reinforcement has been effected in accordance with the above Raymont and Allen patents by forming integral ribs and bars on the rear surface of the forward ball striking wall. In order to effect this rib pattern, the core pieces that form the rear surface of the ball striking wall, as well as the ribs themselves, must be withdrawn rearwardly in order to clear the ribs. However, the perimeter wall extending rearwardly from the forward wall inhibits the direct rearward removal of these core pieces from the forward wall during the casting operation. Therefore, it has been commonplace to either make these reinforcing elements very shallow on the order of 0.030 to 0.050 inches in rearward depth or to rearwardly taper the ribs almost to a point extending rearwardly from the forward face so that these core pieces can move laterally somewhat as they are removed from the forward wall at the completion of the casting cycle.

These limitations detract from the effectiveness of the reinforcing elements and their capability of achieving a lighter front ball striking wall. As described in the Raymont patent, the effectiveness of the reinforcement of the forward wall is determined by the "I" or "T" beam configuration of the reinforcing elements. The amount of reinforcement is determined in part by the depth and width of the reinforcing walls in a plane transverse of the ball striking wall at its point furthest from the ball striking wall. In an "I" beam configuration, the width of the cross piece away from the forward wall, can be selected as desired but is extremely difficult to mold because of the undercut on the rear web. Such increase in web width and augmentation of the depth of the reinforcement has not to this date been possible prior to the present invention, and hence the full advantages of increased perimeter weighting, superior face reinforcement, and face enlargement have not been thus far fully exploited.

Another problem addressed by the present invention is the achievement of increasing the benefits of perimeter weighting by simply adding weight to the perimeter of the club head itself. This technique of course has found considerable success in low impact club heads such as putters, where overall club head weight is in no way critical, and in fact in many low impact clubs that have found considerable commercial success, the club heads weigh many times that of metal wood heads, sometimes three or four times as heavy.

To this date, however, increased perimeter weighting has not been found easy because of the weight and impact strength requirements in metal woods. An understanding of perimeter weighting must necessarily include a discussion of the parameter radius of gyration. The radius of gyration in a golf club head is defined as the radius from the geometric or ball striking axis of the club along the club face to points of club head mass under consideration. Thus, in effect the radius of gyration is the moment arm or torquing arm for a given mass under consideration about the ball striking point. The total moments acting on the ball during impact is defined as the sum of the individual masses multiplied by their moment arms or "radii of gyration". And this sum of the moments can be increased then by either increasing the length of the individual moment arms or by increasing the mass or force acting at that moment arm or combinations of the two.

Since it is not practical, except for the techniques discussed in the above Raymont and Allen patents, to add weight to the perimeter wall because of the weight limitations of metal woods and particularly the driving woods, one alternative is to increase the moment arm or radius of gyration. This explains the popularity of today's "jumbo" woods although many of such woods do not have enlarged faces because of the requirement for structural integrity in the front face.

In the Allen, U.S. patent application, Ser. No. 882,561, some of these problems are solved with a composite face wall that includes an impact supporting wall that is investment cast with the remainder of the head(-without the sole plate which is a separate piece as cast). This impact supporting wall is rigidified by a pattern of integrally cast reinforcing bars that extend forwardly from the forward wall rather than rearwardly as described in the above discussed Raymont and Allen patents. This reinforcing pattern has a depth of approximately 0.150 inches which is significantly greater than reinforcing patterns possible on the rear of the ball striking faces of prior constructions. This increased depth provides far greater supporting wall reinforcement. It is also easily cast because the core piece that forms these deep depth reinforcing elements are removed by a direct forward withdrawal unencumbered by the perimeter wall that inhibits rearward core withdrawal inside the club head. In the exemplary embodiment of this pattern of reinforcing bars, the reinforcing bars are formed into hexagonal unit cells having a major diameter of 0.500 inches, although other geometric patterns are within the scope of the present invention.

This reinforced supporting wall is covered by a very hard plastic ball striking insert that is cast in situ (in place) over the supporting wall. That is, after the head is investment cast, the forward wall is cleaned and vulcanized with a bonding agent and placed in a mold that carries the configuration of the outer surface of the insert and an elastomeric material is either poured or injected under pressure into the mold to form the insert. One material that has been found successful is a Shore D 75 hardness polyurethane, which results in a very hard high frequency ball striking surface. This plastic insert, not only provides a very hard ball striking surface, but more importantly because it is intimately bonded to the forward wall and the reinforcing bars, it provides an effective "I" beam support with the bars for the forward wall as opposed to a "T" beam support found in today's rearwardly reinforced ball striking wall. It can be easily demonstrated by engineering calculation that I beam supports for transverse loads are substantially stronger than T beam supports.

The increase in the radius of gyration is accomplished by extending the heel and toe portions of the club head further from the geometric center of the face wall, beyond present day parameters for high impact club heads. These extensions provide greater effective heel and toe weighting. The heel of the club head is formed by extending the club face significantly beyond the hosel, that is, on the side of the hosel opposite the ball striking area, and extending the top wall and rear wall to accommodate this extended face. These extensions of the heel and toe are accomplished without any significant increase in overall club head weights, by extending the club head top wall downwardly almost to the plane of the sole plate, and flattening the rear wall almost to the plane of the sole plate. This design reduces perimeter wall and sole plate wall weight for a given size head and enables the saved weight to be positioned at the extended heel and toe portions of the club head.

It is a primary object of the present invention to ameliorate problems described above in the manufacture of golf clubs.

SUMMARY OF THE PRESENT INVENTION

In accordance with the present invention, an improved metal wood golf club is provided having an enlarged or "jumbo" metal club head with a crowned top wall extending rearwardly from a ball striking face wall, a toe wall, and a heel wall also projecting rearwardly from the face wall—but the club head has no conventional sole plate.

The toe wall and the heel wall are enclosed by the top wall and a pair of spaced generally vertical weighting walls integral with and extending rearwardly from the face wall. The two areas enclosed by the top wall, heel and toe walls, and weight walls are hollow to achieve the desired head weight and the area between the walls is opened, and the weight of the sole plate that normally encloses that area is redistributed to the weight wall to achieve true heel and toe weighting.

Prior attempts to manufacture very large stainless steel metal club heads with larger than normal faces has proved exceedingly difficult because of the 195 to 210 gram weight requirements for driving club heads to achieve the most desirable club swing weights. Thus, to the present date stainless steel "jumbo" club heads have been manufactured with standard sized face walls, deeply descending top walls from the front to the rear of the club head, and angular faceted sole plates all designed to decrease the gross enclosed volume of the head but which do not detract from the apparent, not actual, volumetric size of the head. This has led to several manufacturers switching from stainless steel to aluminum alloys, which are of course lighter, to enlarge the head as well as the face.

Following the principles of the present invention, it is possible to enlarge not only the overall head but the face as well and to at the same time dramatically increase the heel toe weighting of the head. Basically, these objectives are achieved by a combination of a honeycomb reinforcing network formed integrally on the rear surface of the forward wall between the weighting walls and a redistribution of the weight of the conventional sole plate, which is eliminated in this design, and the weight saved on the thinner than normal face wall to the weighting walls themselves. The two enclosed areas defined by the top wall, heel and toe walls, and weighting walls are hollow, but they may be foam-filled if desired to reduce ball impact noise levels.

During the golf swing, air flows partly around the bottom of the forward wall into the open cavity between the weighting walls and exits at the rear below the top wall. To prevent this top wall from creating turbulence and noise as this air flow exits the club head cavity, an air foil hollow channel is provided on the rear underside of the top wall to provide a smooth exit for the air flow.

Other objects and advantages of the present invention will appear more clearly from the following detailed description.

DETAILED DESCRIPTION OF THE PREFERRED EMBODIMENT

Figure 1:
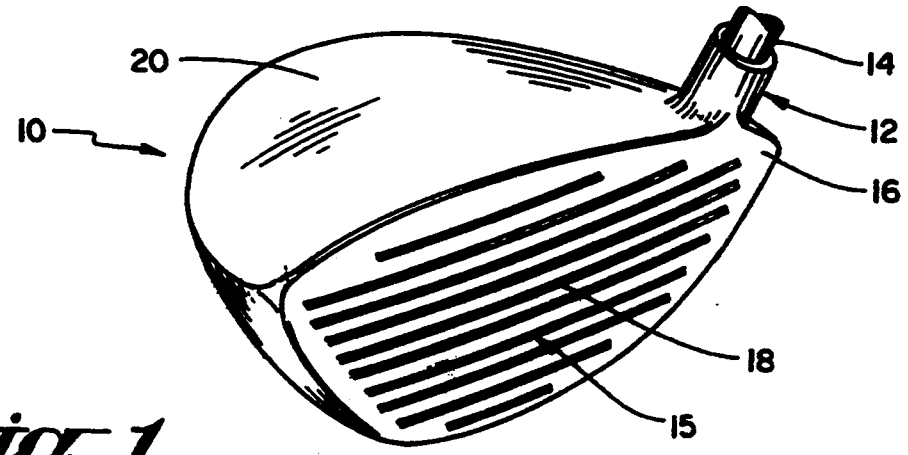
FIG. 1 is a perspective view of the club head of the golf club according to the present invention.
Figure 2:
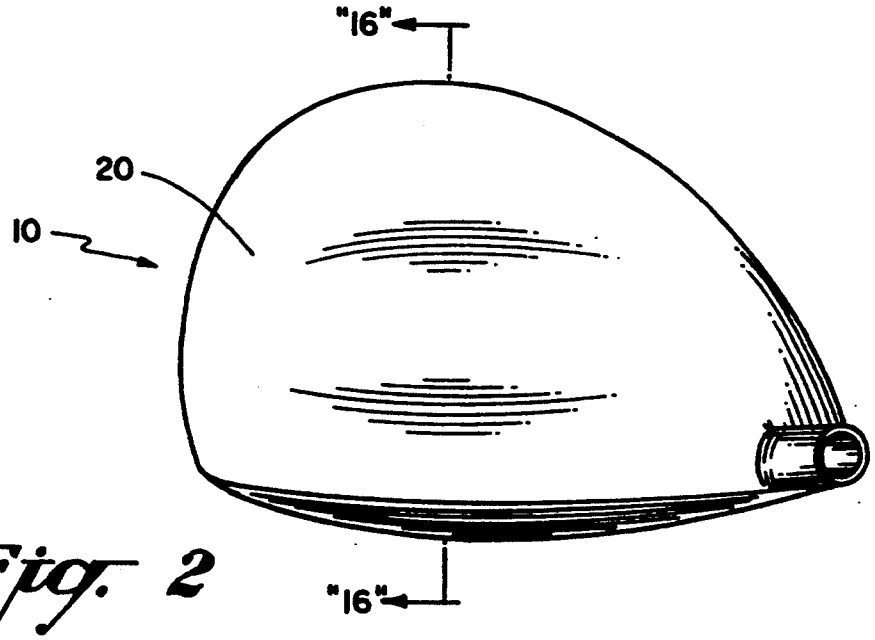
FIG. 2 is a top view of the club head illustrated in FIG. 1.
Figure 3:
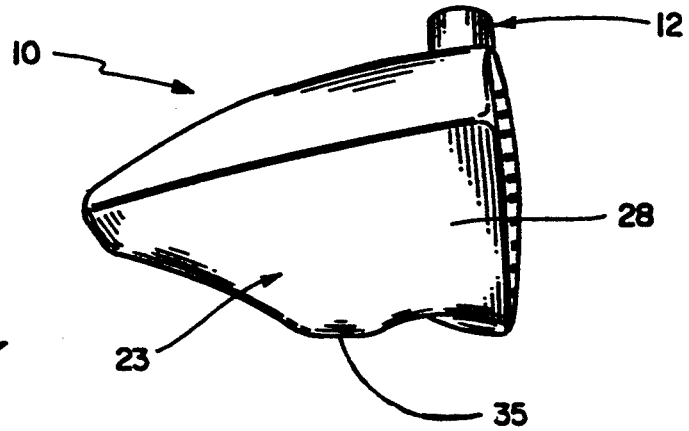
FIG. 3 is a left side view of the club head illustrated in FIG. 1.
Figure 4:
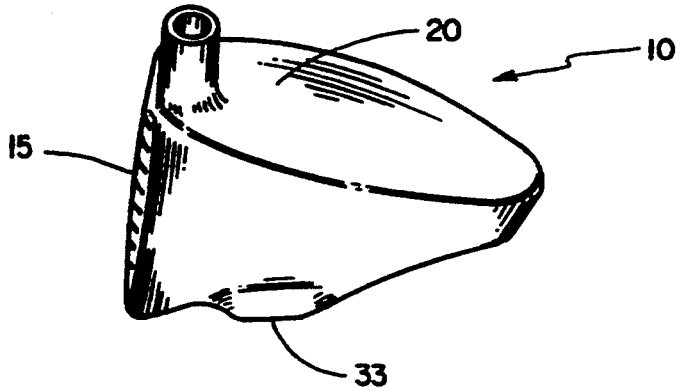
FIG. 4 is a right side view of the club head illustrated in FIG. 1.

Referring to the drawings and particularly FIGS. 1 to 9, a metal wood club head 10 is illustrated according to the present invention having a female hosel 12 adapted to receive a shaft 14 shown only partly in FIG. 1, and it should be understood that the shaft 14 has a grip at its butt end to complete the club head and the present invention is directed not to the club head alone but to the entire club.

It should be understood that the club head 10 is preferably investment cast stainless steel because the principles of the present invention are best utilized in making an enlarged face and/or overall club head from stainless steel where it is difficult to achieve the desired 195 to 210 gram weight. However, it should also be understood that these principles can be utilized in the manufacture of club heads from other metals including aluminum and magnesium alloys.

The club head 10 has a forward face wall 15 that is larger than normal both vertically and horizontally, and it has a portion 16 that extends outwardly from the hosel 12 to contribute to the extended horizontal length of the face 15. The projection 16 and its accompanying perimeter weighting is partly the subject of the Allen, U.S. patent application Ser. No. 882,561 described above in the Background of the Present Invention and by itself forms no part of the present invention except for the fact that the present invention has particular, but not singular, utility in enlarged face metal club heads.

Face 15 has a vertical height at its ball striking point 18 of 1.625 inches and has a horizontal length through point 18 of 3.670 inches. As noted above, the overall weight of head 10 is between 195 and 210 grams.

A crowned top wall 20 is formed integrally with face or forward wall 15, and it has a length from front to back; i.e., along the target line, in a vertical plane extending through point 18 of 2.700 inches.

Figure 5:
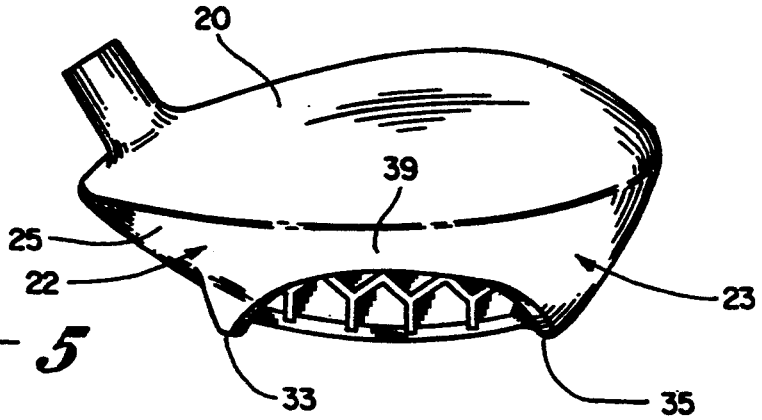
FIG. 5 is a rear view of the club head illustrated in FIG. 1.
Figure 6:
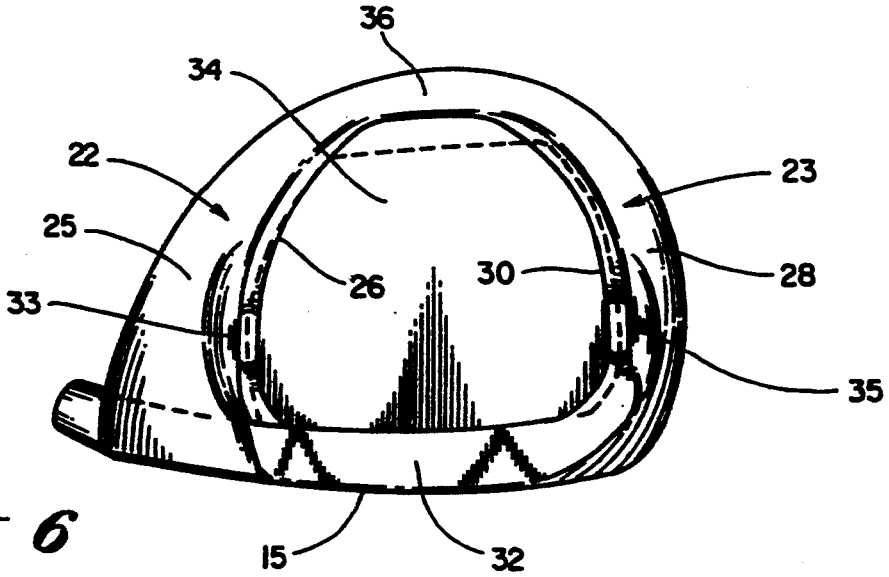
FIG. 6 is a bottom view of the club head illustrated in FIG. 1.
Figure 7:
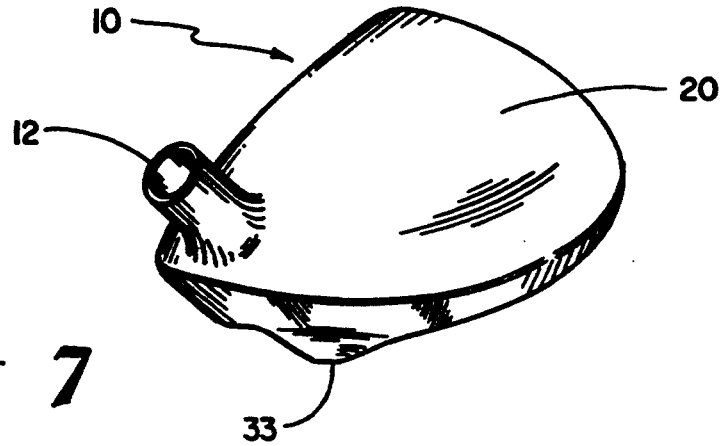
FIG. 7 is a right rear perspective of the club head illustrated in FIG. 1.
Figure 8:
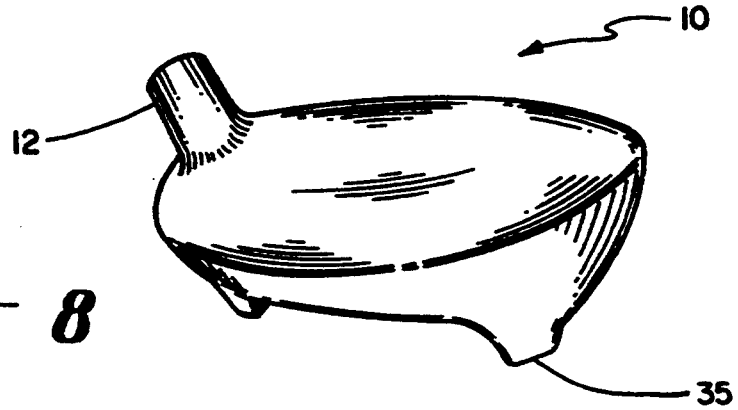
FIG. 8 is a left rear perspective of the club head illustrated in FIG. 1.

The club head is heel and toe weighted by a hollow heel weight 22 and a hollow toe weight 23 both projecting rearwardly from face wall 15 and best seen in FIGS. 5 and 6.

Figure 10:
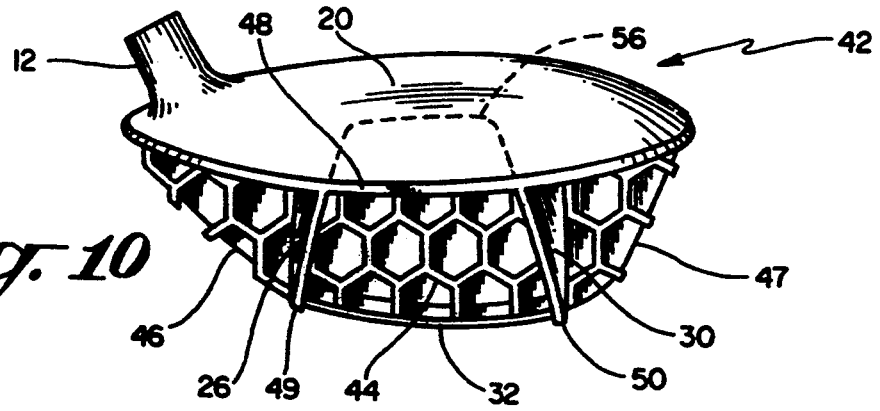
FIG. 10 is a rear view of the top molding of the club head illustrated in FIG. 1.

The heel weight 22 is defined by the heel portion of top wall 20, an arcuate heel wall 25, and a generally vertical curved weight wall 26 seen in FIG. 6 but best seen in the sub-assembly molding of FIG. 10.

Figure 9:
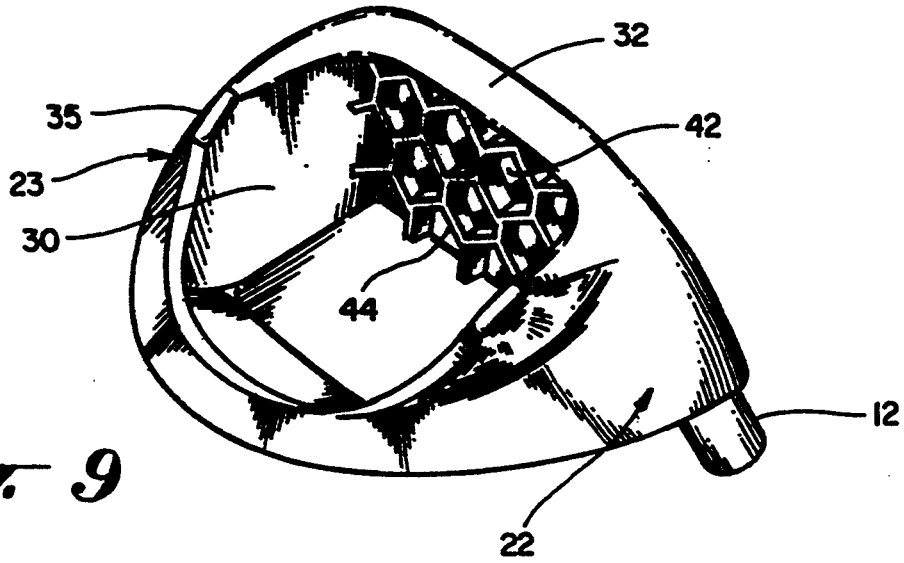
FIG. 9 is an enlarged bottom right perspective of the club head illustrated in FIG. 1.

The toe weight wall 23 consists of the toe portion of the top wall 20, an arcuate toe wall 28, and a generally vertical curved toe weight wall 30, also shown in FIG. 6 but best shown in the sub-assembly molding of FIG. 10, as well as in the perspective view of FIG. 9.

Thus, the heel weight 22 and the toe weight 23 are hollow, and since they are not directly behind the ball striking area of face 15, do not create any significant hollow sound upon ball impact, but these areas may be polyurethane foam-filled during manufacture to reduce noise levels or "pinging" sounds upon ball impact.

The forward wall 15 has a bottom rim 32 that extends rearwardly from the forward surface of the forward wall 15 approximately 0.350 inches. The area designated 34 between the heel and toe weights 22 and 23 is open so that the lead line 34 associated with reference numeral 34 is actually pointing to the lower surface of the top wall 20, which is approximately 0.60 inches in thickness. The toe wall 28 and the heel wall 25 are also about 0.060 inches thick as are the weight walls 26 and 30, although it is desirable if weight constraints permit to manufacture walls 26 and 30 at about 0.080 inches in thickness to not only provide increased heel and toe weighting but to support the forward wall 15 at points significantly closer to the ball striking point 18 than the heel and toe walls 25 and 28. Because the weight walls 26 and 30 are formed integrally with forward wall 15 and are closer to the impact point 18 than the outer walls, they achieve much more effective support for the forward wall 15 against ball impact forces which of course are in a direction normal to the face wall 15 at or about point 18.

Because the club head 10 essentially has no sole plate, and conventionally the rear central area of the sole plate and the bottom edge of the face wall define club head set-up; i.e., loft, lie, and open-closed face, this function is provided in club head 10 by a heel platform 33 projecting downwardly from heel weight 22 and a toe platform 35 projecting downwardly from toe weight 23. By adjusting the extent of projection; i.e., the extent that the platforms 33 and 35 project downwardly, the entire set-up geometry can be varied as desired bearing in mind that the rim 32 provides with platforms 33 and 35 a 3 point set-up for club head 10.

Figure 16:
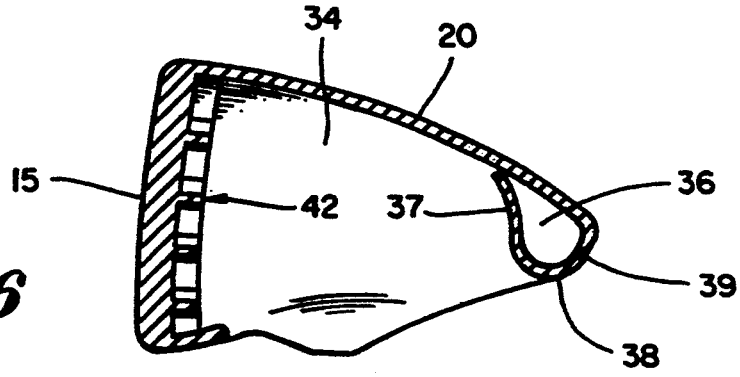
FIG. 16 is a cross-section through the assembled club head taken generally along line 16—16 of FIG. 2.

As seen most clearly in FIG. 16, a hollow channel 36 is provided between the heel weight 22 and the toe weight 23 at the rear underside of the top wall 20. The channel 36 provides as a concave under surface 37 that connects with a "soft" convex surface 38 and a slightly curved rear surface 39 that together smoothly direct air flow indicated by the dotted line in FIG. 16, from the open area 34 between the heel and toe weights, thereby minimizing any turbulence in air flow exiting open area or cavity 34 that would otherwise occur if the rear end of the top wall 20 were simply exposed to this air flow. That is, without channel 36 air exiting cavity 34 would simply pass over the sharp exposed rear edge of top wall 20 creating an undesirable whistling sound that is obviated by channel 36, and this is an important aspect of the present invention because unusual noises are very disconcerting to the average golfer, particularly during the golf swing.

As seen in FIGS. 5, 9, 10 and 16, the rear of the face wall 15 has an integral reinforcing and stiffening network 42 projecting rearwardly therefrom. In addition to reinforcing and stiffening the face wall, the honeycomb cellular network 42 permits face wall 15 to be constructed thinner and hence lighter than normal and the weight thus saved is redistributed according to the present invention to the heel weight wall 26 and the toe weight wall 30.

As best seen in FIG. 16, face wall 15 has a thickness of about 0.100, and the honeycomb network 42 has a depth front to rear of about 0.150 inches. Each cell in the network 42 is defined by six interconnected walls to form a hexagon and the walls of one cell are interconnected to, as well as common to, the surrounding cells. To achieve the benefits of the present invention, at least two or more of the individual cells, such as cell 44 shown in FIG. 9, are surrounded by either complete or incomplete cells. The cell walls about 0.100 inches in thickness, since they are formed integrally with forward wall 15, create a T-beam effect in reinforcing the forward wall 15. The cell diameters are approximately 0.400 inches in minor diameter and about 0.480 inches in major diameter, although they may be larger or smaller and still achieve the intended benefit.

While wall 15 is about 0.100 inches in thickness, it may be significantly thinner with the honeycomb network 42 because of its depth and cell diameter and wall thickness. The deeper the honeycomb network, the greater the reinforcing effect and hence the thinner face wall 15 may be and still provide the necessary structural integrity and existing ball impact without face collapse or fracture.

The honeycombing network 42 may be replaced with cellular networks having different geometric configurations, one of which is a plurality of straight intersecting reinforcing bars intersected by similar orthogonally related bars. To achieve the advantages of this network, it is desirable that there be at least three reinforcing bars in one direction intersected by at least two reinforcing bars in the orthogonal direction.

Normally in investment casting metal woods, they are cast in two pieces, a top and a bottom. The top casting consists of the crowned top plate, the hosel, the ball striking forward face and a truncated spheroidal rear wall that circles the rear of the top wall and joins the face wall at its ends. The bottom member is simply the sole plate which is generally flat, straight at its forward end where it is welded to the face wall and semicircular at its rear end where it is welded to the lower part of the rear wall.

Figure 11:
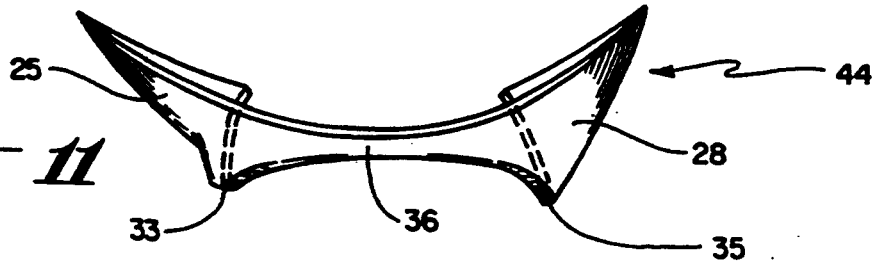
FIG. 11 is a rear view of the bottom plate for the top molding illustrated in FIG. 10.
Figure 12:
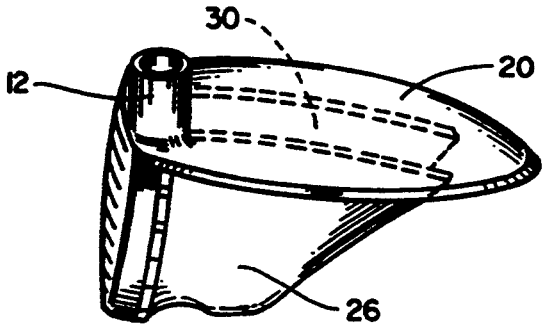
FIG. 12 is a right side view of the top molding illustrated in FIG. 10.
Figure 13:
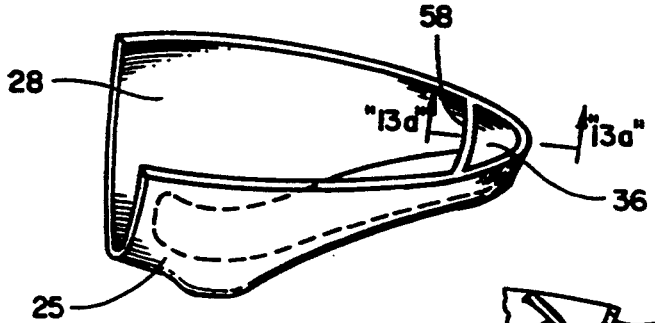
FIG. 13 is a right perspective of the bottom plate illustrated in FIG. 11.
Figure 13A:
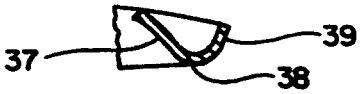
FIG. 13*a* is a cross-section of the bottom plate taken generally along line 13*a*—13*a* of FIG. 13.
Figure 14:
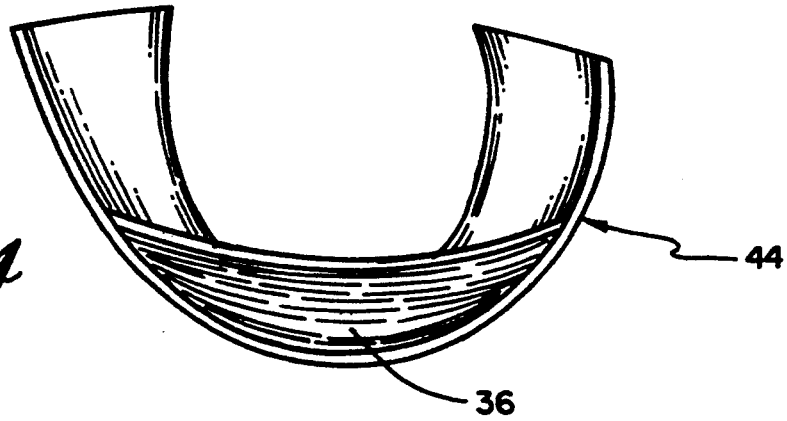
FIG. 14 is a top view of the bottom plate illustrated in FIGS. 11 and 13.
Figure 15:
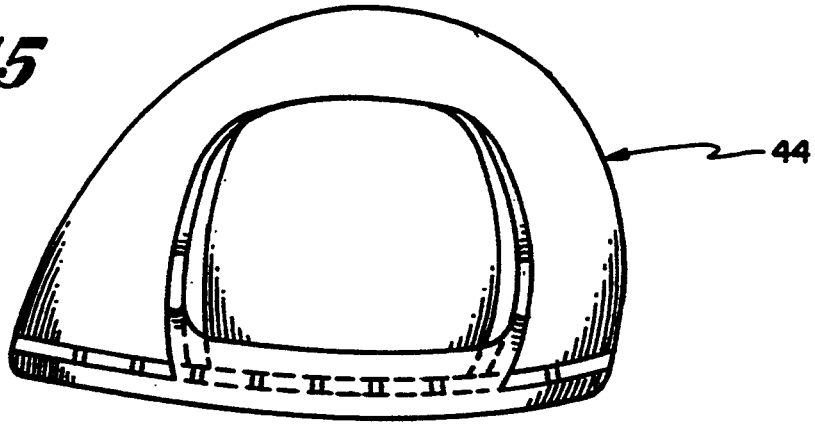
FIG. 15 is a bottom view of the bottom plate illustrated in FIGS. 11 and 13 with portions of the top plate included.

According to the present invention and as seen in FIG. 10, the top member casting includes the top wall 20, the hosel 12, the face wall 15, the weight walls 26 and 30, and the top molding is generally indicated in FIG. 10 by the reference numeral 42. A bottom member casting 44 is illustrated in FIGS. 11, 13 and 14 and includes heel wall 25, toe wall 28, and rear channel 36, as well as platforms 33 and 34.

After casting, the bottom casting 44 is welded to the top casting 42 along the bottom edges 46 and 47 of the top casting, along edge 48 of the top wall 20, and along edges 49 and 50 of the weight walls 26 and 30.

The advantage in forming the bottom member 44 including what is essentially the rear wall of the club, is that it permits the honeycombing network 45 to be formed deeper than in conventional clubs because core piece removal is far easier when not surrounded by a rear wall in the same casting. It is important also that the weight walls 26 and 30 be formed as a part of the top casting 42 because this not only increases their effectiveness as support for the forward face wall 15 but also if the weight walls were part of the bottom member 44, they would be difficult to weld to the top member and the face wall 15.

While not shown in the drawings, it is also within the scope of the present invention to form the channel 36 in the rear of the top wall 20 and then weld a separate cover plate, indicated by the dotted lines in FIG. 10 and identified by reference numeral 56, over than channel. This eliminates the difficulty in hand grinding the weld line between the bottom plate and the lower surface of the top wall 20 indicated along the inside wall of the channel designated by reference numeral 58 in FIG. 13.

I claim:

1. A metal wood, comprising: a shaft, a relatively thin-walled club head connected to the shaft constructed predominantly of metal, said club head having a relatively thin forward wall with a ball striking surface, a relatively thin perimeter wall extending rearwardly from the forward wall having a top wall portion, a toe wall portion, a heel wall portion and a bottom wall portion, a generally vertical toe weight wall integral with the top wall portion extending rearwardly from near the forward wall adjacent the toe wall portion, and a generally vertical heel weight wall integral with the top wall portion extending rearwardly from near the forward wall adjacent the heel wall portion, said club head being at least partly open between the toe weight wall and the heel weight wall to expose the interior club head area between the top wall portion and the bottom wall portion bounded by the heel and toe weight walls, so as to maintain club head weight at acceptable levels and to promote heel and toe weighting, said face having a central ball striking point, said toe weight wall extending rearwardly from a point near the forward wall and spaced a substantial distance from the ball striking point in a plane parallel to the forward wall toward the toe wall portion, said heel wall extending rearwardly from a point near the forward wall and spaced a substantial distance from the ball striking point in a plane parallel to the forward wall toward the heel wall portion.

2. A metal wood, comprising: a shaft, a relatively thin-walled club head connected to the shaft constructed predominantly of metal, said club head having a forward wall with a ball striking surface, a relatively thin perimeter wall extending rearwardly from the forward wall having a top wall portion, a heel wall portion, a toe wall portion and a bottom wall portion, and means to effect enhanced heel and toe weighting and maintain overall club head weight including a first generally vertical wall integral with the top wall portion extending rearwardly from near the forward face adjacent the heel wall portion, and a second generally vertical wall integral with the top wall portion extending rearwardly from near the forward wall adjacent the toe wall portion, said club head being at least partly open between the toe weight wall and the heel weight wall to expose the interior club head area between the top wall portion and the bottom wall portion bounded by the heel and toe weight walls, so as to maintain club head weight at acceptable levels and to promote heel and toe weighting, said face having a central ball striking point, said toe weight wall extending rearwardly from a point near the forward wall and spaced a substantial distance from the ball striking point in a plane parallel to the forward wall toward the toe wall portion, said heel wall extending rearwardly from a point near the forward wall and spaced a substantial distance from the ball striking point in a plane parallel to the forward wall toward the heel wall portion.

3. A heel and toe weighted metal wood, comprising: a shaft, a relatively thin-walled club head connected to the shaft constructed predominantly of metal, said club head having a forward wall with a ball striking surface, and means to heel and toe weight the club head while maintaining its structural strength and desired swing weight including a thin-wall projecting integrally and rearwardly from the forward wall defining a hollow heel weight and a thin wall projecting integrally and rearwardly from the forward wall defining a toe weight, said club head being open between the heel weight and the toe weight without increasing club head weight over acceptable values, said face having a central ball striking point, said toe weight extending rearwardly from a point near the forward wall and spaced a substantial distance from the ball striking point in a plane parallel to the forward wall, said heel weight extending rearwardly from a point near the forward wall and spaced a substantial distance from the ball striking point in a plane parallel to the forward wall.

4. A heel and toe weighted metal wood, comprising: a shaft, a relatively, thin-walled club head connected to the shaft constructed predominantly of metal, said club head having a forward wall with a ball striking surface, and means to heel and toe weight the club head while maintaining its structural strength and desired swing weight including a thin wall projecting integrally and rearwardly from the forward wall defining a hollow heel weight and a thin wall projecting integrally and rearwardly from the forward wall defining a toe weight, and means to increase the wall thickness and hence the weight of the heel weight and the toe weight including an integral reinforcing cellular network projecting rearwardly from the forward wall between the heel and toe weights including a plurality of interconnected cells at least a plurality of which are surrounded by other cells, so the weight on the forward wall is distributed to the heel and toe weights,said club head being open between the heel weight and the toe weight without increasing club head weight over acceptable values, said face having a central ball striking point, said toe weight extending rearwardly from a point near the forward wall and spaced a substantial distance from the ball striking point in a plane parallel to the forward wall, said heel weight extending rearwardly from a point near the forward wall and spaced a substantial distance from the ball striking point in a plane parallel to the forward wall.

5. A metal wood, comprising: a shaft, a relatively thin-walled club head connected to the shaft constructed predominantly of metal, said club head having a thin forward wall with a ball striking surface, a top edge and a bottom edge, and a heel and toe, a relatively thin perimeter wall at least partly around the forward wall including a large generally planar wall extending rearwardly from one of the edges, and means for heel and toe weighting the club head including a first thin wall connected to one side of the planar wall defining a first hollow channel and projecting rearwardly from the heel of the forward wall, and a second thin wall connected to one side of the planar wall defining a second hollow channel and projecting rearwardly from the toe of the forward wall, said first and second channels being spaced defining an open unenclosed area therebetween, reducing weight in the area redistributing weight to the first and second channels for improved heel and toe weighting.

6. A metal wood, comprising: a shaft, a club head connected to the shaft constructed predominantly of metal, said club head having a forward wall with a ball striking surface and a heel and toe, a crowned top wall projecting rearwardly from the forward wall, a toe wall projecting from the toe of the forward wall, a heel wall projecting from the heel of the forward wall, and means to heel and toe weight the club head without increasing head weight including a heel weight wall spaced inwardly from the heel wall and extending rearwardly from and connected to the forward wall, and a toe weight wall spaced inwardly from the toe wall and extending rearwardly from and connected to the forward wall, said weight walls being spaced and defining an area therebetween that is unenclosed thereby reducing the head weight in the area and permitting increased weight distribution to the heel and toe weight walls.

7. A metal wood as defined in claim 6, including a reinforcing cellular network integral with and projecting rearwardly from the forward wall between the weight walls permitting the forward wall to be thinner and the saved weight redistributed to the toe and heel walls and the toe and heel weight walls to enhance heel and toe weighting.

8. A metal wood as defined in claim 6, including a hollow channel in the underside of the top wall at a rear portion thereof between the weight walls having a curved lower surface to minimize turbulent air flow through said area.

9. A method of manufacturing a metal wood, comprising: forming a top member as a single piece including a forward wall, a top wall, a hosel projecting from the top wall and a pair of generally vertical weight walls projecting rearwardly from the forward wall, forming a bottom member in one or more pieces including a toe wall and a heel wall, and joining the toe wall to the forward wall and one vertical weight wall and joining the heel wall to the forward wall and the other vertical weight wall.

10. A method of manufacturing a metal wood as defined in claim 9, wherein the top and bottom members are investment cast.

11. A metal wood, comprising: a shaft, a relatively thin-walled club head connected to the shaft constructed predominantly of metal, said club head having a forward wall with a ball striking surface, a heel weight including a first perimeter wall extending rearwardly from the forward wall having a top wall portion, a connected integral heel and bottom wall portion, a first generally vertical wall integral with the top wall portion extending generally rearwardly and enclosing the top wall portion, the heel wall portion and the bottom wall portion defining a first hollow chamber extending rearwardly from the forward wall, a toe weight including a second perimeter wall extending rearwardly from the forward wall having a top wall portion, a connected integral toe and a bottom wall portion, a second generally vertical wall integral with the second top wall portion extending generally rearwardly and enclosing the second top wall portion, the toe wall portion and the second bottom wall portion defining a second hollow chamber extending rearwardly from the forward wall, portions of the club head between the toe weight and the heel weight being open to maintain overall metal wood club head weight to compensate for weight added by the first and second generally vertical walls, said face having a central ball striking point, said second generally vertical wall extending rearwardly from a point near the forward wall and spaced a substantial distance from the ball striking point in a plane parallel to the forward wall toward the toe wall portion, said first generally vertical wall extending rearwardly from a point near the forward wall and spaced a substantial distance from the ball striking point in a plane parallel to the forward wall toward the heel wall portion.

12. A metal wood, comprising: a shaft, a relatively thin-walled club head connected to the shaft constructed predominantly of metal, said club head having a forward wall with a ball striking surface, a heel weight including a first perimeter wall extending rearwardly from the forward wall having a top wall portion, a connected integral heel wall portion and a bottom wall portion, a first generally vertical wall integral with the top wall portion extending generally rearwardly enclosing the top wall portion, the heel wall portion and the bottom wall portion defining a first hollow chamber extending rearwardly from the forward wall, a toe weight including a second perimeter wall extending rearwardly from the forward wall having a top wall portion, a connected integral toe and a bottom wall portion, a second generally vertical wall integral with the second top wall portion and extending generally rearwardly and enclosing the second top wall portion, toe wall portion and bottom wall portion defining a second hollow chamber extending rearwardly from the forward wall, said club head being at least partly open between the toe weight and the heel weight to expose the interior club head area between the top wall portion and bottom wall portion bounded by the first and second generally vertical walls, to maintain overall metal wood head weight to compensate for weight added by the first and second generally vertical walls, said face having a central ball striking point, said second generally vertical wall extending rearwardly from a point near the forward wall and spaced a substantial distance from the ball striking point in a plane parallel to the forward wall toward the toe wall portion, said first generally vertical wall extending rearwardly from a point near the forward wall and spaced a substantial distance from the ball striking point in a plane parallel to the forward wall toward the heel wall portion, one of said wall portions completely covering the area of the club head between the heel weight and the toe weight to strengthen the heel and toe weights and provide a more traditional shape for the golfer.

* * * * *